US010017003B2

(12) United States Patent
Heidenreiter et al.

(10) Patent No.: US 10,017,003 B2
(45) Date of Patent: Jul. 10, 2018

(54) CAP FOR A PEN OR PENCIL

(71) Applicant: Schwan-STABILO Cosmetics GmbH & Co. KG, Heroldsberg (DE)

(72) Inventors: Thomas Heidenreiter, Nuremberg (DE); Britta Lorenz, Nuremberg (DE)

(73) Assignee: Schwan-Stabilo Cosmetics GMBH & Co. KG, Heroldsberg (DE)

( * ) Notice: Subject to any disclaimer, the term of this patent is extended or adjusted under 35 U.S.C. 154(b) by 0 days.

(21) Appl. No.: 15/202,006

(22) Filed: Jul. 5, 2016

(65) Prior Publication Data

US 2017/0001466 A1 Jan. 5, 2017

(30) Foreign Application Priority Data

Jul. 2, 2015 (DE) ..... 20 2015 004 739 U

(51) Int. Cl.

| | |
|---|---|
| ***B43K 23/08*** | (2006.01) |
| ***A45D 40/20*** | (2006.01) |
| ***B43K 23/10*** | (2006.01) |
| ***B43K 23/12*** | (2006.01) |
| *A45D 40/00* | (2006.01) |

(52) U.S. Cl.

CPC ..... *B43K 23/08* (2013.01); *A45D 40/20* (2013.01); *B43K 23/10* (2013.01); *B43K 23/12* (2013.01); *A45D 2040/0018* (2013.01); *A45D 2040/201* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,643,605 | A * | 2/1987 | Iwasaki | B43K 23/12 401/202 |
| 5,154,526 | A * | 10/1992 | Bothe | B43K 23/12 401/202 |
| 7,708,486 | B2 | 5/2010 | Keda | |
| 2010/0266026 | A1 | 10/2010 | Chuang | |
| 2011/0236122 | A1 | 9/2011 | Rolion et al. | |

FOREIGN PATENT DOCUMENTS

| | | |
|---|---|---|
| DE | 79 00 569 | 4/1980 |
| DE | 10 2015 106 062 | 10/2016 |
| EP | 2508359 | 10/2012 |
| WO | 02/26555 A1 | 4/2002 |

* cited by examiner

*Primary Examiner* — David Walczak
(74) *Attorney, Agent, or Firm* — Angela Holt; Frank M. Caprio; Bradley Arant Boult Cummings LLP

(57) ABSTRACT

A cap (1) for a pen or pencil (100) has an opening (2) for the introduction of the pen or pencil (100) and a sealing bead (3) that extends radially inwards and runs around the longitudinal axis (L) of the cap (1) with a closed contour. The cap (1) has at least one first component (K1) with a first flexibility and a second component (K2) with a second flexibility that is greater than the first flexibility. The interior (7) of the cap (1) in the region lying opposite the opening (2) in relation to the sealing bead (3) and in the region of the sealing bead (3) is delimited by the first component (K1). The second component (K2) lies on the outside in the region of the sealing bead (3) along a closed contour on the first component (K1). The adjustability of the cap (1) by a force acting in the radial direction in the region of the sealing bead (3) is greater than in a region lying opposite the opening (2) in relation to the sealing bead (3).

20 Claims, 3 Drawing Sheets

CAP FOR A PEN OR PENCIL

REFERENCE TO RELATED APPLICATIONS

This application claims priority under 35 U.S.C. 119 to German Application No. 20 2015 004 739.4, filed on Jul. 2, 2015, which is herein incorporated by reference in its entirety.

BACKGROUND AND SUMMARY

The invention relates to a cap for a pen or pencil that has an opening for the introduction of the pen or pencil and a sealing bead that extends radially inwards and runs around the longitudinal axis of the cap with a closed contour, the cap having at least one first component with a first flexibility and a second component with a second flexibility that is greater than the first flexibility.

A cap of the type specified at the start is disclosed, for example, in U.S. Pat. No. 7,708,486. The cap consists of two components, the first component being comprised of a soft synthetic resin, and the second component being comprised of a hard synthetic resin. In one embodiment both the soft and the hard component each form a region of the inside and a region of the outside of the cap.

In one region of this embodiment, that extends from the closed end of the cap towards its opening up to a cross-over region, the interior of the cap is delimited by the soft component. The soft component is in contact with the pen or pencil in a region of the tip of the pen or pencil and in a region of the shaft. In this way sealed covering of the tip of the pen or pencil is achieved. The hard component extends from the cross-over region towards the closed end of the cap, rests against the soft component and forms a region of the outside. In the region that extends from the opening to the cross-over region the interior of the cap is entirely delimited by the hard component. In the cross-over region where the soft component, extending from the closed end of the cap towards the cross-over region and delimiting the inside, and the hard component, extending from the opening of the cap towards the cross-over region and delimiting the interior, meet, the soft component is guided from the inside towards the outside of the cap and extends further towards the opening, resting against the hard component.

Furthermore, there is formed in the cross-over region on the inside of the cap a sealing bead, made of the hard component and extending inwardly in the radial direction, that locks with a region of the pen or pencil such that inadvertent detachment of the cap from the pen or pencil is prevented.

The manufacture of a cap disclosed by U.S. Pat. No. 7,708,486 requires a complex production method because the soft component must be guided from the inside of the cap to the outside.

Furthermore, this type of cap for sealing pen or pencils that can be sharpened, made of wood, extruded plastic sleeves or wax pencils proves to be inadequate because the outside diameters of these pen or pencils are subject to large tolerance fluctuations ($^{15}/_{100}$ mm). On the one hand these pens or pencils have a large out-of-roundness ($^{5}/_{100}$ mm) due to the production method. On the other hand the outside diameters can increase or decrease with a change in the air humidity. Therefore, not only is the outer form different from pen or pencil to pen or pencil, but it can also change over time. A cap of the type specified at the start then sits on the respective pen or pencil with different degrees of security. Therefore, on the basis of the production tolerance or the climatic conditions the cap can either be hard to place over the pen or pencil or to be pulled off of the latter, or on the contrary, it can inadvertently fall off of the pen or pencil. In this way, when transporting the pen or pencil, for example in a pocket, soiling can occur.

Moreover, by sharpening the pen or pencils manually further irregularities can be produced on the outside of the pen or pencil, and this can make it impossible to produce sufficient contact of the tip with the soft component so as to counter premature drying out.

As a possibility for sealing the tips of pen or pencils with varying outer contours a so-called cone seal was developed. However, this leads to different lengths of the pen or pencil arrangement with the cap placed on it. Moreover, it is a disadvantage of cone seals that they can suddenly become loose because only linear sealing, and no axial coverage, can be produced.

In view of these problems in the prior art, the object underlying the invention is to further develop a cap of the type specified at the start such that the cap enables reliable sealing of the tip of a pen or pencil, in particular of a pen or pencil that can be sharpened, with a changeable outer form, and moreover to provide a simple method of manufacture for the production of this type of cap.

According to the invention this object is achieved in that the interior of the cap in the region lying opposite the opening in relation to the sealing bead and in the region of the sealing bead is delimited by the first component, the second component lies on the outside in the region of the sealing bead along a closed contour on the first component, and the adjustability of the cap by a force acting in the radial direction in the region of the sealing bead is greater than in a region lying opposite the opening in relation to the sealing bead.

The invention can be traced back to the knowledge that a tip of a pen or pencil can be protected against drying out by enclosing it in a diffusion resistant space. With a cap according to the invention this space is formed as follows:

In a state in which the cap sits on the pen or pencil, the tip is enclosed by a space that is delimited by the shaft of the pen or pencil, the sealing bead and the region of the cap that lies opposite the opening in relation to the sealing bead. The region of the cap that lies opposite the opening in relation to the sealing bead and the sealing bead have the first, less flexible component. The flexibility of a component is to be understood as meaning its property of deforming by the effect of an external force. A component with a large degree of flexibility deforms more greatly with the same external force than a component with a small degree of flexibility.

In general, a component with a small degree of flexibility has a higher diffusion resistance than a component with a large degree of flexibility. The diffusion resistance of a component is understood to mean its property of being impermeable to liquids and gases. A component with a high diffusion resistance is less permeable here than a component with a low diffusion resistance. Since the inside of the cap is delimited in the region of the tip by the first component with a small degree of flexibility, this region of the cap therefore has a high diffusion resistance.

By using the first component with a small degree of flexibility in the region of the sealing bead lying opposite the opening the cap is, moreover, stable enough to be able to be grasped well with the hand in this region and be placed on the pen or pencil and be pulled off of it.

In order to guarantee sealed enclosure of the tip of the pen or pencil by means of the first component with the high diffusion resistance the cap has three further properties. First of all, the cap has the sealing bead. The latter runs round the inside of the cap along a closed contour and comprises the first component. If a cap for sealing a pen or pencil with an unchanging outer contour is used, due to a correspondingly formed sealing bead, sealed enclosure of the tip of the pen or pencil can already be guaranteed. Here the sealing bead rests tightly against the shaft of the pen or pencil or locks onto a region of the shaft. With a pen or pencil with a changeable outer contour or outer irregularities a sealing bead on its own is, however, inadequate in order to guarantee permanent sealing of the tip of the pen or pencil.

So that the sealing bead permanently rests tightly against the shaft even on pens or pencils with a changeable outer contour, the adjustability of the cap in the region of the sealing bead is secondly greater than in a region lying opposite the opening in relation to the sealing bead. The adjustability of the cap in a region is understood to mean the property that a wall region located in this region is deflected towards the radial component by a force acting on this region and that has a radial component. This deflection is greater for a region with a large degree of adjustability than for a region with a small degree of adjustability. In general, a component with a small degree of flexibility has a smaller degree of adjustability than a component with a large degree of flexibility.

As will be explained in the following, due to the higher degree of adjustability of the cap in the region of the sealing bead, the sealing bead lies tightly against the shaft of the pen or pencil, and so reliable closure of the tip of the pen or pencil is achieved. According to the invention a minimum inside diameter of the cap in the region of the sealing bead is chosen to be smaller than a minimum outside diameter of the shaft of the pen or pencil in the region which, in the state in which the cap sits on the pen or pencil, should be in contact with the sealing bead. If this type of cap is placed on the pen or pencil, the shaft of the pen or pencil comes into contact with the sealing bead. By means of the adjustability of the cap in the region of the sealing bead the latter is pushed outwards, and every region of a closed contour running round the shaft of the pen or pencil comes into contact with a region of the sealing bead. The inside diameter of the cap in the region of the sealing bead and the adjustability of the cap can be chosen such that this can also be achieved when the shaft has out-of-roundnesses or the diameter or the form of the shaft change over time.

Thirdly, in the region of the sealing bead the cap has a second component lying on the first component on the outside along a closed contour. The second component has a high degree of flexibility and acts like a binding that supports the cap in the region with the greater degree of adjustability. In this way the cap is protected against damage in this region, for example against excessive deflection of the wall region which could lead to the cap breaking. The second component can also additionally press the sealing bead against the shaft of the pen or pencil and further improve the sealing of the tip of the pen or pencil.

Since the second component has a greater degree of flexibility than the first component, it is also softer and offers better grip than the latter. Since the second component forms a region of the outside of the cap, in this region the cap can be gripped well with the fingers, and can also be pulled off of the pen or pencil and placed on it without any problem, even if one has damp or creamy hands.

Therefore, the functionality of the cap is achieved by an appropriate choice of the first and the second component and a sealing bead adapted to the diameter of the pen or pencil, the adjustability in the region of the sealing bead being greater than in the region that lies opposite the opening in relation to the sealing bead. The first component is chosen such that the required stability, dimensional accuracy and diffusion resistance of the cap is achieved. The second component is chosen such that the cap offers good grip and is sufficiently adjustable in the region of the sealing bead. In this way strong, close, air-tight and diffusion resistant closure of the tip of the pen or pencil is achieved. The pen or pencil can thus be protected against premature drying out. The cap can sit securely on the pen or pencil, but can still be easily pulled off. The cap sits securely on the pen or pencil and can be pulled off without excessive exertion. Clearly lower cap pull-off forces can be guaranteed.

According to the invention the first component can comprise a thermoplastic with an elasticity modulus of 1200-2400 N/mm2, preferably ABS or MABS with an elasticity modulus of approximately 2000 N/mm2. According to the invention the second component can comprise a thermoplastic elastomer with a hardness range of 10 ShA-90 ShD, preferably TPE-S or TPE-U with approximately 60 ShA.

In another embodiment of the invention a wall thickness of the first component in the region of the sealing bead can be less than a wall thickness of the region which lies opposite the opening in relation to the sealing bead. A wall thickness is to be understood here to mean an average wall thickness. The wall thickness in the region of the sealing bead and/or in the region that lies opposite the opening in relation to the sealing bead can be a function of the location. However, the wall thickness can also be equal everywhere. By reducing the wall thickness in the region of the sealing bead the adjustability of the first component in the region of the sealing bead can be increased. Furthermore, a saving of the first component, and so a saving of cost can be achieved.

The second component that lies on the outside of the first component has a greater degree of flexibility than the first component. For this reason the adjustability of the cap in the region of the sealing bead in which the wall with the reduced thickness is stabilised by the second component lying on the outside is always greater than in the region of the cap that lies opposite the opening in relation to the sealing bead.

In another embodiment of the invention a maximum wall thickness of the first component can be smaller in the region of the sealing bead than a minimum wall thickness of the first component in the region which lies opposite the opening in relation to the sealing bead. The wall thickness in the region of the sealing bead and/or in the region lying opposite the opening in relation to the sealing bead can be equal everywhere in the corresponding regions. However, it can also be a function of the location. By further reducing the wall thickness in the region of the sealing bead to a minimum value, the adjustability of the cap in this region can be further increased. Moreover, there can thus be further savings on material and costs.

An embodiment in which a notch that does not totally penetrate the first component in the radial direction is formed on the outside of the cap at least in the region of the sealing bead and the second component is positioned in this notch is also advantageous. The notch is formed such that the wall thickness of the first component in the region of the sealing bead is smaller than a minimum wall thickness in the region that lies opposite the opening in relation to the sealing bead. In this way the greater adjustability of the cap in the region of the sealing bead is achieved.

In one embodiment of the invention the second component can be positioned in the notch so that it is aligned with the outside of the first component of the cap in another axial region. In this way the connection of the second component to the first component can be particularly stable with respect to forces acting in the longitudinal direction along the outside of the cap. If, for example, the cap is gripped by the fingers on the soft component and is pulled off of the pen or pencil, the likelihood of the second component being detached from the cap by the effect of this force is reduced. However, the second component can also project from the outside of the first component or be set back from the outside of the first component.

In another possible embodiment the first component and/or the second component can be elastically deformable. In this way the sealing of the tip of the pen or pencil can be additionally improved. Upon placing the cap on the pen or pencil the region of the sealing bead is deflected radially outwards together with the second component running round the outside of the cap. If the first and/or the second component has/have elastic properties, in this way a re-set force pressing the sealing lip tightly and securely against the shaft of the pen or pencil can be brought about. In this way the sealing of the space in which the tip of the pen or pencil is enclosed is additionally increased.

Another advantageous embodiment of the invention is characterised in that the first component and/or the second component extend/s at least partially into a region between the opening and the sealing bead. The interior of the cap in the region between the opening and the sealing bead can be delimited here by the first component. The second component can extend into the region between the opening and the sealing bead. As already mentioned, the more flexible second component offers more grip than the first component. Since the outer region of the cap formed by the second component increases, the grip offered by the cap also improves.

Moreover, it can be advantageous if the first and/or the second component comprise/comprises a plastic. In this way different forms of the cap can be produced inexpensively in a simple manner, for example by an injection moulding technique.

The invention also creates a method of producing a cap of the type specified at the start. Thermoplastics are advantageously used here for the first and the second component. The second component can also be made of silicone that can be processed by injection moulding. The region of the cap made of the first component can be produced by an injection moulding method. If the increased adjustability of the cap in the region of the sealing bead is produced by reducing the wall thickness by means of a notch, this can also already be produced in this procedural step. In a second production step the second component is applied to the first component in a heated state. This leads to re-heating of the first component. Since the second component lies around the first component, in this region it acts like a thermal sleeve. Tempering of the first material takes place, by means of which the latter can acquire greater flexibility.

The production method described above is particularly easy because only two production steps which are based on a known injection moulding method are required in order to produce the cap. A cap according to one embodiment of the invention can thus be produced inexpensively in large quantities.

Within the framework of this disclosure the cap according to the invention should also be protected together with a cosmetic pencil that can be sharpened. The cosmetic pencil can be, for example, a wax pencil. It is difficult to sharpen these pencils and, in addition, they have very out-of-round and varied outside diameters. If the tip of a wax pencil is exposed to air for a long period of time it dries out and the pencil becomes unusable. The tip of a wax pencil easily breaks off if, for example, the pencil falls to the ground. Moreover, soiling caused by wax pencils is difficult to clean. These problems can be eliminated by using a cap according to the invention.

BRIEF DESCRIPTION OF THE DRAWINGS

In the following description the invention is explained in more detail with reference to the drawings given as examples. The drawings show as follows.

DETAILED DESCRIPTION

Figure 1:
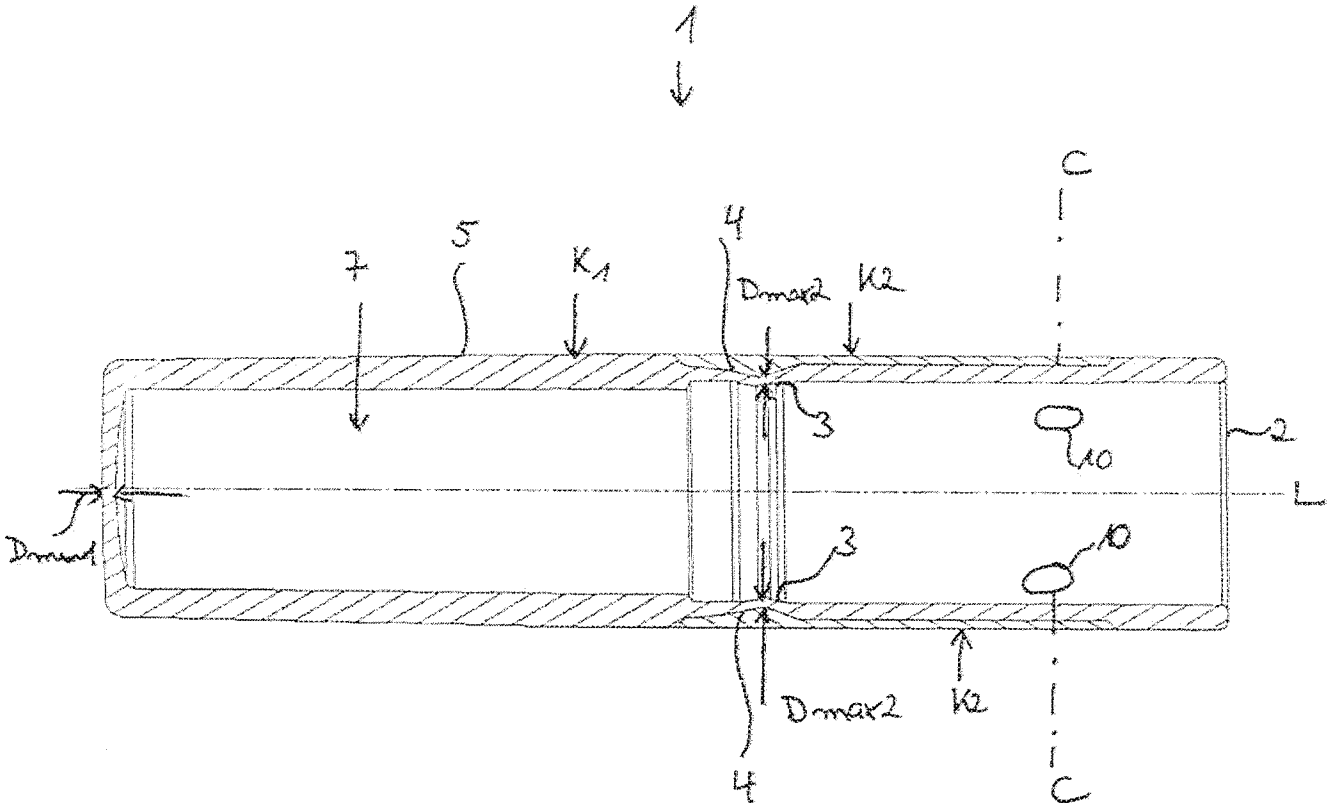
FIG. 1 a longitudinal section of a cap according to one embodiment of the invention, FIG. 2 a longitudinal section of the cap shown in FIG. 1 and which has been placed on a pen or pencil, and FIG. 3 a section of the cap shown in FIG. 1 along line C-C.

FIG. 1 shows a longitudinal section of a cap 1. The cap 1 has an opening 2 for the introduction of a pen or pencil 100 that is not shown here (see FIG. 2 in this regard) into the interior 7. The interior 7 is only delimited by the first component K1. On the side of the cap 1 facing towards the interior 7 a sealing bead 3 is formed. The sealing bead 3 extends radially inwards and runs around the longitudinal axis L of the cap 1 in a closed contour. The sealing bead 3 comprises the first component K1.

In the region of the sealing bead 3 a notch 4 is formed on the side of the first component K1 facing away from the interior 7. Due to the notch 4 the maximum wall thickness Dmax2 of the first component K1 in the region of the sealing bead 3 is smaller than the minimum wall thickness Dmin1 of the first component K1 on the side opposite the opening 2 in relation to the sealing bead 3. The reduction of the wall thickness of the first component K1 in this region increases the adjustability of the cap 1 in the region of the sealing bead 3. This means: if a force is acting upon the wall 5 of the cap 1 in the radial direction, the region of the sealing bead 3 is deflected further in the radial direction with the same force as a region of the wall 5 of the cap 1 that is positioned on the side opposite the opening 2 in relation to the sealing bead 3. The notch 4 also extends into the region of the first component K1 that extends from the sealing bead 3 towards the opening 2.

The second component K2 is positioned in the notch 4. The second component K2 positioned flush with the first component K1 forming the outside of the cap 1. However, the second component K2 can also be projecting or set back. The second component K2 acts like a binding. It increases the stability of the cap 1 in the region of the reduced wall thickness. Since the second component K2 has greater flexibility than the first component K1 the adjustability of the cap in the region of the sealing bead 3 can also be larger with the second component K2 lying on it on the outside than in the region that is positioned on the side lying opposite the opening 2 in relation to the sealing bead 3. Since the second component K2 extends beyond the region of the sealing bead 3 the grip offered by the cap 1 can, moreover, be increased by choosing the second component K2 appropriately.

Moreover, the cap 1 shown in FIG. 1 has recesses 10 on the side of the sealing bead 3 facing towards the opening 2. However, these are not absolutely necessary for the invention. The recesses 10 will be discussed in more detail with reference to FIG. 3.

Figure 2:
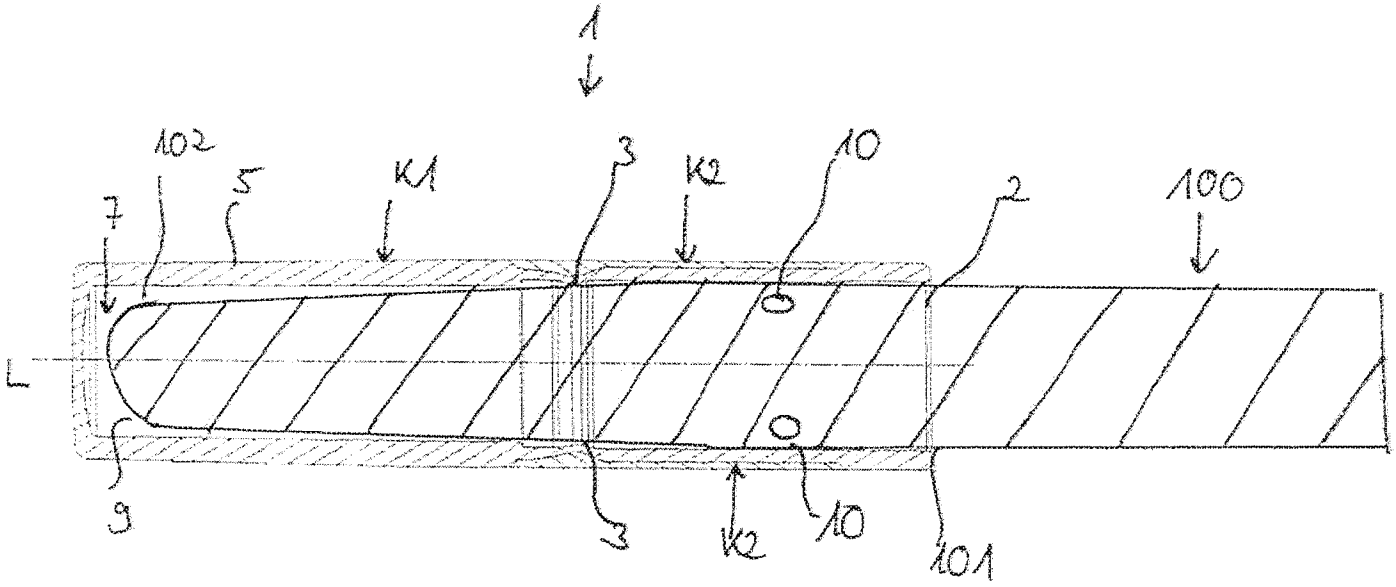

FIG. 2 shows a longitudinal section of the cap 1 shown in FIG. 1 which sits on a pen or pencil 100. The sealing bead 3 lies on the shaft 101 of the pen or pencil 100. Secure fitting of the cap 1 on the pen or pencil 100 can be achieved, for example, as follows: The inside diameter of the cap 1 in the region of the sealing bead 3 is chosen to be smaller than the minimum anticipated outside diameter of the pen or pencil 100 in the region in which the cap 1 placed on the pen or pencil 100 is intended to touch the outer wall of the pen or pencil 100. If the cap 1 is placed on the pen or pencil 100, the wall 5 of the cap 1 in the region of the sealing bead 3 is pressed outwards. The first component K1 and the second component K2 are elastically deformable. A restoring force is thus brought about by the deformation of the wall 5 to the outside. This restoring force pushes the sealing bead 3 tightly and securely against the pen or pencil 100.

In the arrangement shown in FIG. 2 the tip 102 of the pen or pencil 100 is enclosed in the rest of the interior 9 that is formed by the shaft 101 of the pen or pencil 100, the sealing bead 3 and the region of the cap 1 that extends from the sealing bead 3 in the direction away from the opening 2. Both the sealing bead 3 and the inside of the wall 5 of the cap 1 that is positioned on the side of the sealing bead 3 that lies opposite the opening 2 comprise the first component K1. Since the first component K1 has a high diffusion resistance, the tip 102 of the pen or pencil 100 is protected against drying out by the enclosure in the rest of the interior 9.

Figure 3:
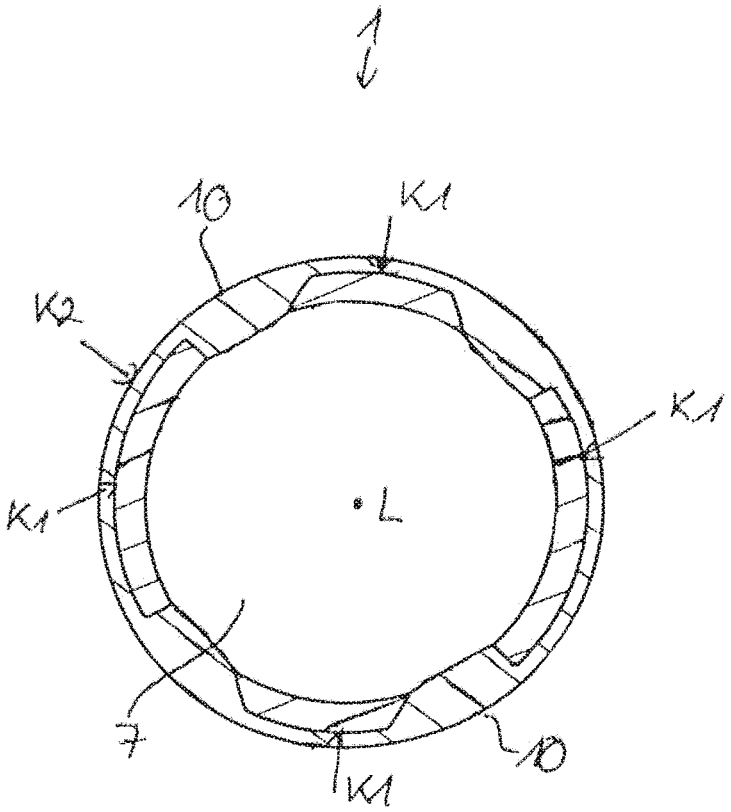

FIG. 3 shows a section of the cap shown in FIG. 1 taken along line C-C. In addition to the notch 4, these recesses 10 fully passing from the outside of the cap 1 into its interior are formed in the first component K1. The second component K2, which rests against the first component K1 on the outside, extends into the recesses 10 and is aligned with the inside and with the outside of the first component K1. In this way the second component K2 is connected particularly securely to the first component K1 with respect to a force acting in the longitudinal direction of the cap.

LIST OF REFERENCE NUMBERS

1 cap
2 opening
3 sealing bead
4 notch
5 wall
7 interior
9 rest of the interior
10 recess
100 pen or pencil
101 shaft
102 tip

The invention claimed is:

1. A cap (1) for a pen or pencil (100), the cap comprising:
an opening (2) for the introduction of the pen or pencil (100) and
a sealing bead (3) that extends radially inwards and runs around a longitudinal axis (L) of the cap (1) with a closed contour,
at least one first component (K1) with a first flexibility and
a second component (K2) with a second flexibility that is greater than the first flexibility, characterised in that an interior (7) of the cap (1) in a region lying opposite the opening (2) in relation to the sealing bead (3) and in a region of the sealing bead (3) is delimited by the first component (K1), the second component (K2) lies on an outside in the region of the sealing bead (3) along a closed contour on the first component (K1), and the adjustability of the cap (1) by a force acting in the radial direction in the region of the sealing bead (3) is greater than in the region lying opposite the opening (2) in relation to the sealing bead (3).

2. The cap according to claim 1, characterised in that a wall thickness of the first component (K1) in the region of the sealing bead (3) is less than a wall thickness of the first component (K1) in the region which lies opposite the opening (2) in relation to the sealing bead (3).

3. The cap according to claim 1 characterised in that a maximum wall thickness (Dmax2) of the first component (K1) is smaller in the region of the sealing bead than a minimum wall thickness (Dmin1) of the first component (K1) in the region which lies opposite the opening (2) in relation to the sealing bead (3).

4. The cap according to claim 1 characterised in that a notch (4) that does not fully penetrate the first component (K1) in the radial direction is formed on an outside of the cap (1) at least in the region of the sealing bead (3), and the second component (K2) is positioned in this notch (4).

5. The cap according to claim 4, characterised in that the second component (K2) is aligned with an outside of the first component (K1).

6. The cap according to claim 4, characterised in that the second component projects over an outside of the first component (K1).

7. The cap according to claim 4, characterised in that the second component is set back from an outside of the first component (K1).

8. The cap according to claim 1, characterised in that one or both of the first component (K1) and the second component (K2) are elastically deformable.

9. The cap according to claim 1, characterised in that one or both of the first component (K1) and the second component (K2) extend at least partially into a region between the opening (2) and the sealing bead (3).

10. The cap according to claim 1, characterised in that one or both of the first component (K1) and the second component (K2) comprise a plastic.

11. A cosmetic pencil that can be sharpened and that has a cap according to claim 1.

12. A method of producing a cap, the cap comprising
an opening (2) for the introduction of the pen or pencil (100) and
a sealing bead (3) that extends radially inwards and runs around a longitudinal axis (L) of the cap (1) with a closed contour,
at least one first component (K1) with a first flexibility and
a second component (K2) with a second flexibility that is greater than the first flexibility, characterised in that an interior (7) of the cap (1) in a region lying opposite the opening (2) in relation to the sealing bead (3) and in a region of the sealing bead (3) is delimited by the first component (K1), the second component (K2) lies on an outside in the region of the sealing bead (3) along a closed contour on the first component (K1), and the adjustability of the cap (1) by a force acting in the radial direction in the region of the sealing bead (3) is greater than in the region lying opposite the opening (2) in relation to the sealing bead (3),
the method comprising injection molding of the second component (K2) onto the first component (K1), where the second component (K2) is in a heated state.

13. A cap (1) for a pen or pencil (100), the cap comprising:
an opening (2) for the introduction of the pen or pencil (100);

a sealing bead (3) that extends radially inwards and runs around a longitudinal axis (L) of the cap (1) with a closed contour;

at least one first component (K1) with a first flexibility, the first component (K1) comprising an interior (7) of the cap (1) in a region lying opposite the opening (2) in relation to the sealing bead (3), the first component (K1) further comprising the sealing bead (3); and a second component (K2) with a second flexibility that is greater than the first flexibility, the second component (K2) comprising an outside in the region of the sealing bead (3) along a closed contour on the first component (K1), the first component (K1) and the second component (K2) configured such that the adjustability of the cap (1) by a force acting in the radial direction in the region of the sealing bead (3) is greater than in the region lying opposite the opening (2) in relation to the sealing bead (3).

14. The cap according to claim 13, wherein a wall thickness of the first component (K1) in the region of the sealing bead (3) is less than a wall thickness of the first component (K1) in the region which lies opposite the opening (2) in relation to the sealing bead (3).

15. The cap according to claim 13, wherein a maximum wall thickness (Dmax2) of the first component (K1) is smaller in the region of the sealing bead than a minimum wall thickness (Dmin1) of the first component (K1) in the region which lies opposite the opening (2) in relation to the sealing bead (3).

16. The cap according to claim 13, wherein a notch (4) that does not fully penetrate the first component (K1) in the radial direction is formed on an outside of the cap (1) at least in the region of the sealing bead (3), and the second component (K2) is positioned in this notch (4).

17. The cap according to claim 16, wherein the second component (K2) is aligned with an outside of the first component (K1).

18. The cap according to claim 16, wherein the second component (K2) projects over an outside of the first component (K1).

19. The cap according to claim 16, wherein the second component (2) is set back from an outside of the first component (K1).

20. The cap according to claim 16, wherein one or both of the first component (K1) and the second component (K2) extend at least partially into a region between the opening (2) and the sealing bead (3).

* * * * *